US006200003B1

(12) United States Patent
Tseng

(10) Patent No.: US 6,200,003 B1
(45) Date of Patent: Mar. 13, 2001

(54) DECORATIVE LIGHT

(76) Inventor: Jeou-Nan Tseng, No. 539, Sec. 4, Chunghua Rd., Hsinchu (TW)

( * ) Notice: Subject to any disclaimer, the term of this patent is extended or adjusted under 35 U.S.C. 154(b) by 0 days.

(21) Appl. No.: 09/379,315

(22) Filed: Aug. 23, 1999

(51) Int. Cl.[7] ..... F21V 21/00

(52) U.S. Cl. ..... 362/249; 362/226; 362/227; 362/806; 362/800

(58) Field of Search ..... 362/226, 227, 362/249, 800, 806, 549

(56) References Cited

U.S. PATENT DOCUMENTS 5,057,982 * 10/1991 Hanami ..... 362/226
5,672,000 * 9/1997 Lin ..... 362/249
5,709,457 * 1/1998 Hara ..... 362/96
5,829,865 * 11/1998 Ahroni ..... 362/226

* cited by examiner

*Primary Examiner*—Thomas M. Sember
*Assistant Examiner*—Ismael Negron
(74) *Attorney, Agent, or Firm*—Bacon & Thomas

(57) ABSTRACT

A decorative light with a structure that only allows the proper orientation between the LED and the power source is disclosed. The decorative light has a first positioning device provided between the light emitting diode and the socket, such that when the light emitting diode is inserted into the socket, the relationship therebetween ensures a predetermined orientation during the insertion of the light emitting diode into the socket. Furthermore, a second positioning device is provided between the socket and the base, such that when the socket is inserted into the base, the corresponding relationship therebetween ensures a predetermined orientation during the insertion of the socket into the base.

9 Claims, 4 Drawing Sheets

DECORATIVE LIGHT

BACKGROUND OF THE INVENTION

1. Field of the Invention

The present invention relates to a decorative light, and more particularly to a decorative light structure having a predetermined orientation for a light emitting diode (LED) illumination agent to be inserted therein, such that a short is prevented.

2. Description of Related Art

Decorative lights are widely used in all kinds of festivals all over the world. Normally, the decorative lights are strung together by wires, such that the user is able to hang the string of decorative lights on a Christmas tree, a doorframe, etc. to enhance the festive atmosphere.

The decorative light has a light bulb detachably inserted in the top of a socket and a base having the socket threadingly inserted therein. Therefore, the light bulb can be replaced if it is damaged or malfunctions. However, because this kind of decorative light requires 110V electricity, using this kind of decorative lights is not economically efficient. Furthermore, the bulb is not easy to color, which is another reason that this kind of decorative light is not popular any more. In order to overcome the these problems, another kind of decorative light using LEDs as the illumination agent was developed. Because the LED uses only 24V electricity and the plastic cover is made of epoxy resin that is quite easy for the manufacturer to form in the color required, the acceptance of this kind of decorative lights has increased dramatically since introduction to the market. However, during assembly, the proper polarity of the electrodes in this kind of decorative light is crucial. If the electrode of the light is not connected to the proper wire, the LED may be damaged. This often happens when customers are required to replace the bulbs. After a period oftime of using the string of decorative lights, one or more than one of the LEDs may burn out. When replacing the malfunctioned LED with a new one, the user might cause a short in the string of decorative lights by inserting the LED into the socket with the electrodes oriented wrong. That is, the orientation of the LED in the socket is very important.

To overcome this shortcoming, the present invention tends to provide an improved decorative light to mitigate and/or obviate the aforementioned problems.

SUMMARY OF THE INVENTION

The main objective of the invention is to provide an improved decorative light, which has a LED as the illumination source, a socket for receiving the LED in a predetermined orientation and a base for receiving the socket in predetermined orientation, such that the electrode of the LED corresponds to the correct polarity of the wire and a short to the LED is able to be avoided.

Other objects, advantages and novel features of the invention will become more apparent from the following detailed description when taken in conjunction with the accompanying drawings.

DETAILED DESCRIPTION OF PREFERRED EMBODIMENT

Figure 1:
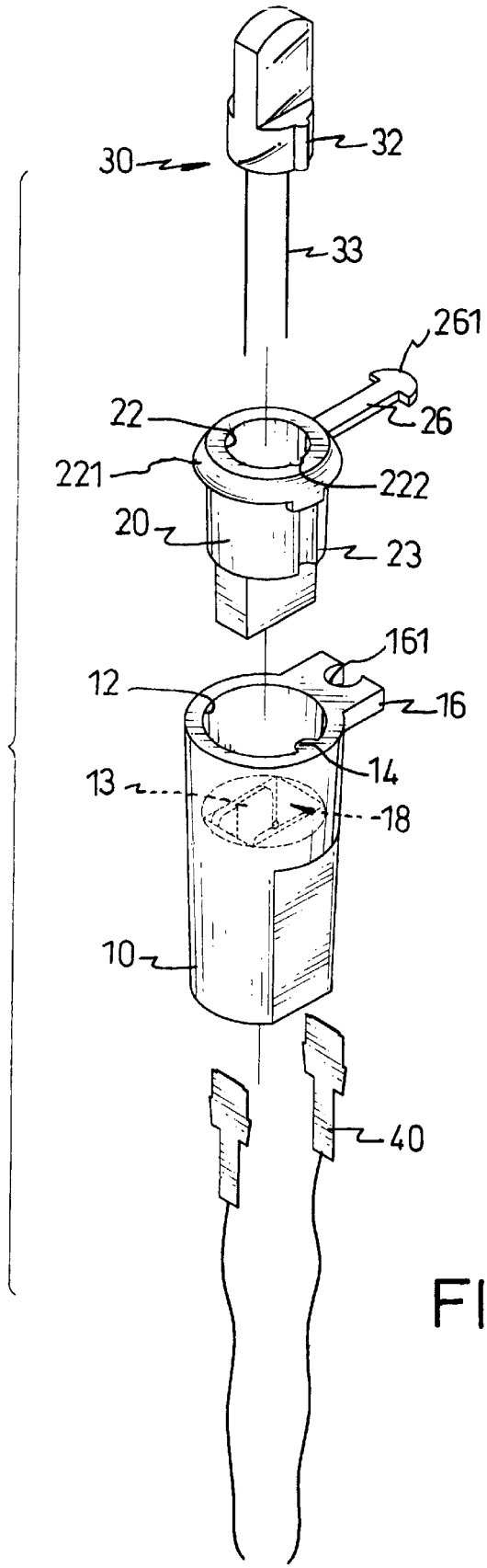
FIG. 1 is an exploded perspective view of the decorative light in accordance with the present invention.

With reference of FIG. 1, the decorative light has a cylindrical base (10), a socket (20) detachably received in the base (10) and a light emitting diode (LED) (30) detachably received in the socket (20). Furthermore, two connecting plates (40) are located in the base (10) to connect the LED (30) to the wire (not shown). The base (10) has a first passage (12) defined therethrough, a second passage (13) defined in the bottom of the first passage (12) and having a diameter smaller than that of the first passage (1 2), a lug (14) extending from the inner periphery defining the first passage (12), a first retaining device (16) formed on the outer periphery of the base and defining therein a cutout (161) and a pair of channels (18) defined on opposite sides in the inner periphery defining the second passage (13) and communicating with the first passage (12). The socket (20), which is partially and detachably received in the first passage (12) of the base (10), has a third passage (22) defined therethrough that communicates with the first passage (12), a flange (221) formed on an end face of the third passage (22) and has a diameter larger than that of the cylindrical base (10), a notch (222) defined in the inner periphery defining the third passage (22), a groove (23) defined to correspond to the lug (14) so as to enable the lug (14) to be slidably received in the groove (23) when the socket (20) is received in the base (10) and an extension (26) integrally formed outside the third passage (22) and provided with a sectorial head (261) formed on the distal end thereof. The LED (30) has a rib (32) formed to correspond to the notch (222) and two connecting wires (33) extending from the bottom of the LED (30).

Figure 5:
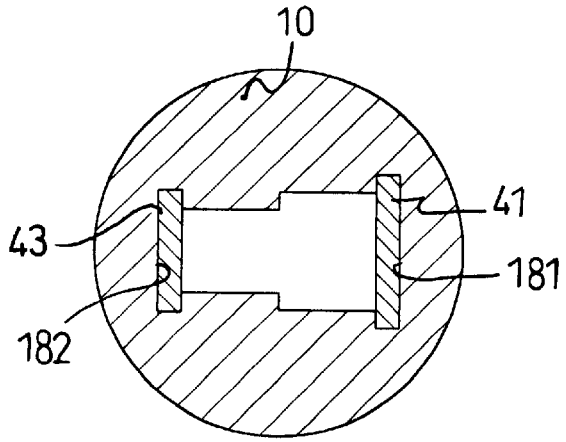
FIG. 5 is a top cross sectional view showing the engagement between the connecting plates and the base as shown in FIGS. 1 and 3.
Figure 2:
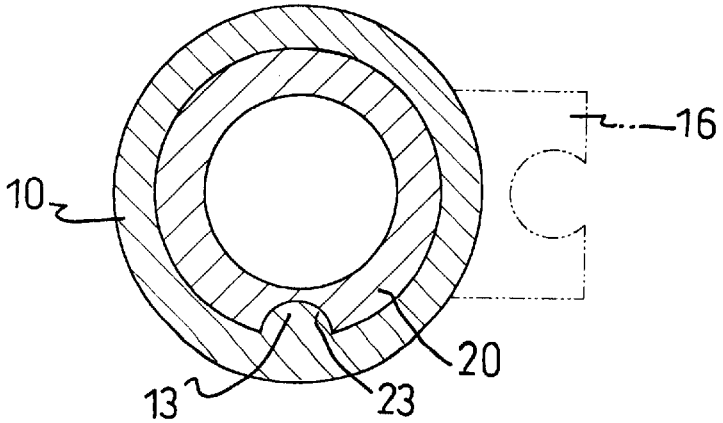
FIG. 2 is a top cross sectional view showing the engagement between the socket and the base in FIG. 1.

During assembly, the two connecting plates (40) are inserted into the channel (18). In order to ensure the polarity of the connecting plates (40) with the electrical wire (not shown), the two connecting plates (40) may be made as a large connecting plate (41) and a small connecting plate (43) and of course the channels (18) must be a large channel (181) and a small channel (182) to correspond to the large connecting plate (41) and the small connecting plate (43), as shown in FIG. 5. After the socket (20) is inserted into the first passage (12) ofthe base (10), the correspondence between the groove (23) and the lug (14), as shown in FIG. 2, ensures the correct orientation feature between the socket (20) and the base (10). Thereafter, the rib (32) and the notch (222) of the socket (20) further ensures that the LED (30) is inserted correctly. After the LED (30) is inserted into the third passage (22), the two connecting wires (33) extends through the third passage (22) to connect with the two connecting plates (40 or 41,43). When the LED (30) is securely inserted into the third passage (22), the extension (26) is folded to clamp the first retaining device (16), and the sectorial head (261) abuts the bottom face of the cutout (161) so as to ensure the socket (20) and the base (10) remain connected.

Figure 4:
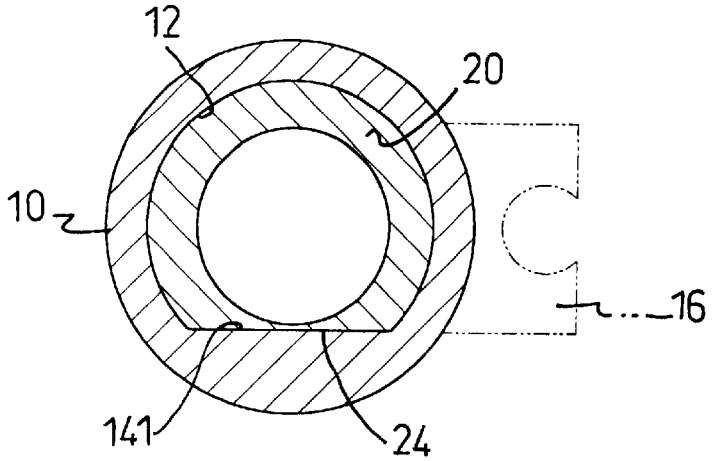
FIG. 4 is a top cross sectional view showing the engagement between the socket and the base of FIG. 3.
Figure 3:
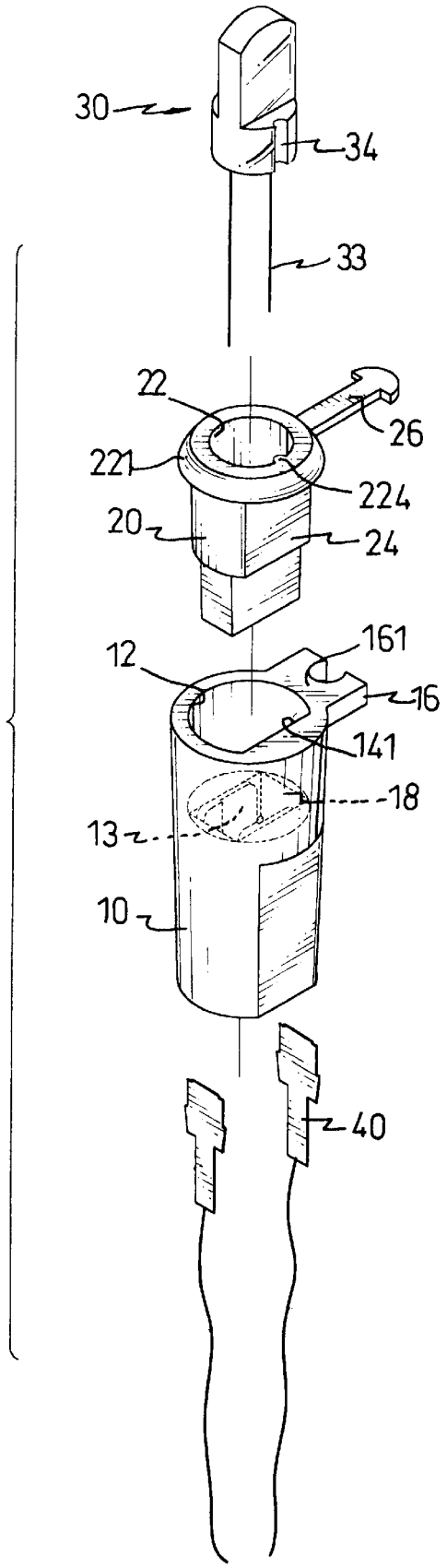
FIG. 3 is an exploded perspective view of alternative embodiment of the decorative light in accordance with the present invention.

With reference to FIG. 3, another embodiment shows that the LED (30) has a groove (34) and the socket (20) has a rib (224) formed on the inner periphery of the third passage (22) to correspond to the groove (34) of the LED (30). Furthennore, the socket (20) has a first flattened face (24) formed to correspond to a second flattened face (141) formed on the inner periphery defining the first passage (12), such that when the socket (20) is inserted into the base (10), the correspondence between the first flattened face (24) and the second flattened face (141), as shown in FIG. 4, will necessitate a single orientation during the insertion of the socket (20) into the base (10).

Figure 6:
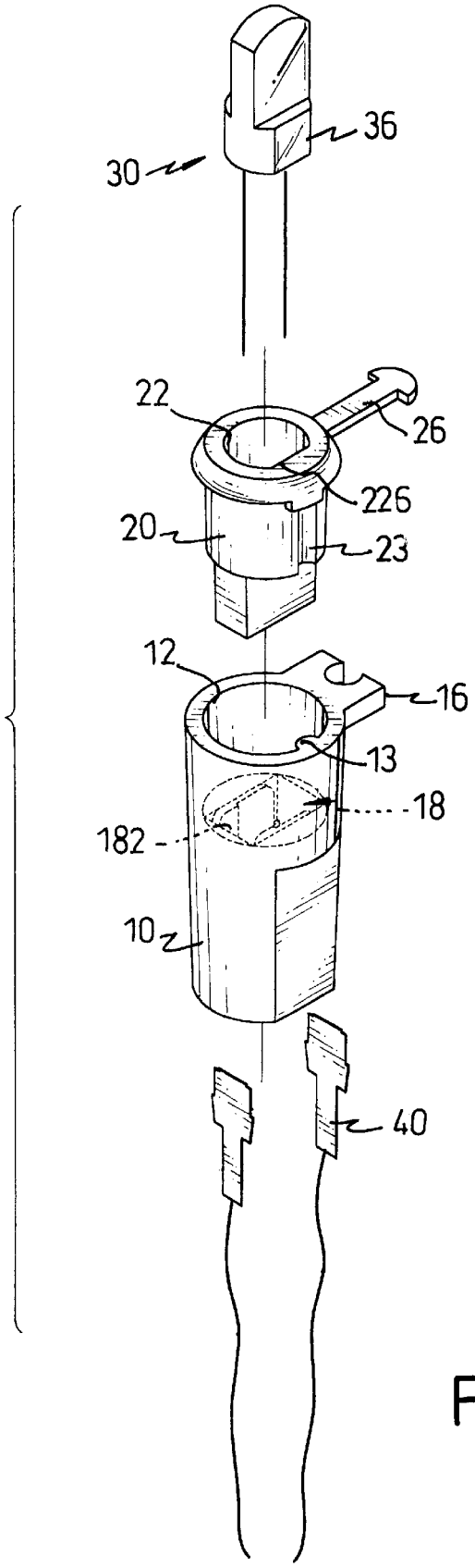
FIG. 6 is an exploded perspective view of another embodiment of the decorative light in accordance with the invention.

Still another embodiment of the invention is shown in FIG. 6, wherein the difference lies in that the LED (30) has a first flattened face (36) and the socket (20) has a second flattened face (226) formed on the inner periphery of the third passage (22) corresponding to the first flattened face (36) of the LED (30), such that when the LED (30) is inserted into the third passage (226) of the socket (20), the first and the second flattened faces (36, 226) will allow only the correct orientation during the insertion of the LED (30) into the socket (20).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. a decorative light comprising a base (10) having a first passage (12) defined therethrough and a second passage (13) defined to communicate with the first passage (12), a socket (20) detachably received in the first passage (12) of the base (10) and having a third passage (22) defined to communicate with the second passage (13), a light emitting diode (30) detachably received in the third passage (22) and two connecting plates (40) securely received in the inner periphery of the second passage (13), wherein the improvements comprise:

a first positioning device provided between the light emitting diode (30) and the socket (20) and having a rib (32) formed on the outer periphery of the LED (30) and a notch (222) defined in the inner periphery of the third passage (22) and corresponding to the rib (32) on the light emitting diode (30), thereby allowing the LED to be inserted into the socket in only one predetermined orientation: and a second positioning device provided between the socket (20) and the base (10) and having a groove (23) defined in the outer periphery of the socket (20) and a lug (14) formed on the inner periphery of the first passage (12) to correspond to the groove (23) in the socket (20), thereby allowing the socket (20) to be inserted into the base (10) in only one predetermined orientation.

2. The decorative light as claimed in claim 1, wherein the first positioning device comprises a rib (32) formed on the outer periphery of the LED (30) and a notch (222) defined in the inner periphery of the third passage (22) and corresponding to the rib (32) on the light emitting diode (30).

3. The decorative light as claimed in 1, wherein the first positioning device comprises a groove (34) defined in the outer periphery of the light emitting diode (30) and a rib (224) formed on the inner periphery of the third passage (22) to correspond to the groove (34) of the light emitting diode (30).

4. The decorative light as claimed in claim 1, wherein the first positioning device comprises a first flattened face (36) formed on the outer periphery of the light emitting diode (30) and a second flattened face (226) formed on the inner periphery of the third passage (22) of the socket (20) corresponding to the first flattened face (36), whereby when the light emitting diode (30) is inserted into the third passage (22), the relationship between the light emitting diode (30) and the socket (20) allows only one predetermined orientation during the insertion of the light emitting diode (30) into the socket (20).

5. The decorative light as claimed in claim 1 further comprising a second positioning device provided between the socket (20) and the base (10) thereby allowing the socket (20) to be inserted into the base (10) in only one predetermined orientation.

6. The decorative light as claimed in claim 5, wherein the second positioning device comprises a groove (23) defined in the outer periphery of the socket (20) and a lug (14) formed on the inner periphery of the first passage (12) and corresponding to the groove (23) in the socket (20).

7. The decorative light as claimed in claim 5, wherein the second positioning device comprises a first flattened face (24) formed on the socket (20) and a second flattened face (141) formed to correspond to the first flattened face (24); whereby when the socket (20) is inserted into the first passage (12), the first and the second flattened faces (24,141) allow only one predetermined orientation.

8. The decorative light as claimed in claim 5, wherein the second positioning device comprises a groove (23) defined in the outer periphery of the socket (2) and a lug (13) formed in the inner periphery of the first passage (12) corresponding to the groove (23) of the socket (20), whereby when the socket (20) is inserted into the base (10), the relationship between the groove (23) and the lug (13) allows only one predetermined orientation during the insertion of the socket (20) into the base (10).

9. A decorative light comprising a base (10) having a first passage (12) defined therethrough and a second passage (13) defined to communicate with the first passage (12), a socket (20) detachably received in the first passage (12) of the base (10) and having a third passage (22) defined to communicate with the second passage (13), a light emitting diode (30) detachably receive din the third passage (22) and two connecting plates (40) securely received in the inner periphery of the second passage (13), wherein the improvement comprises:

a first positioning device provided between the light emitting diode (30) and the socket (20) and having a groove (34) defined in the outer periphery of the light emitting diode (30) and a rib (224) formed on the inner periphery of the third passage (22) to correspond to the groove (34) of the light emitting diode (30); and a second positioning device having a first flattened face (24) formed on the socket (20) and a second flattened face (141) formed on the inner periphery defining the first passage (12) to correspond to the first flattened face (24); whereby when the socket (20) is inserted into the first passage (12) of the base (10), the first and the second flattened faces (24,141) allow only one predetermined orientation.

* * * * *